US007743572B2

(12) United States Patent
Ducharme

(10) Patent No.: US 7,743,572 B2
(45) Date of Patent: Jun. 29, 2010

(54) ANTI-VIBRATION SOUND INSULATOR FOR SUSPENDED CEILING

(75) Inventor: Robert Ducharme, Ste-Anne-des-Plaines (CA)

(73) Assignee: Soprema, Inc., Drummondville (CA)

( * ) Notice: Subject to any disclaimer, the term of this patent is extended or adjusted under 35 U.S.C. 154(b) by 485 days.

(21) Appl. No.: 11/719,080

(22) PCT Filed: Nov. 10, 2005

(86) PCT No.: PCT/CA2005/001718

§ 371 (c)(1),
(2), (4) Date: May 10, 2007

(87) PCT Pub. No.: WO2006/050604

PCT Pub. Date: May 18, 2006

(65) Prior Publication Data

US 2007/0294972 A1 Dec. 27, 2007

(30) Foreign Application Priority Data

Nov. 12, 2004 (CA) ..... 2485280

(51) Int. Cl.
*E04B 1/98* (2006.01)
*E04B 9/00* (2006.01)

(52) U.S. Cl. ..... 52/506.06; 52/512; 52/167.1

(58) Field of Classification Search ..... 52/167.1, 52/167.7–167.9, 506.05, 506.06, 506.08, 52/506.09, 512, FOR. 145
See application file for complete search history.

(56) References Cited

U.S. PATENT DOCUMENTS 2,349,158 A * 5/1944 Fowles et al. ..... 52/506.09
2,841,255 A * 7/1958 Kemp ..... 52/395
3,004,644 A * 10/1961 Hull ..... 52/506.07
3,067,323 A * 12/1962 Kember ..... 362/150

(Continued)

FOREIGN PATENT DOCUMENTS

EP 37517 A1 * 10/1981

(Continued)

OTHER PUBLICATIONS

VMC Architectural Products, Series LP, Low Profile Ceiling Isolation Hangers. 2004, Bulletin LP, p. 3.*

(Continued)

*Primary Examiner*—Richard E Chilcot, Jr.
*Assistant Examiner*—Elizabeth A Plummer
(74) *Attorney, Agent, or Firm*—Fish & Richardson P.C.

(57) ABSTRACT

The invention is directed to an anti-vibration sound insulator for a suspended ceiling which is intended to be used either in residential or commercial applications. The insulator comprises a metal furring devised to be fixed to the ceiling. It also includes a central part comprising a star-shaped element having an upper vertical plate provided with an orifice and two lower plates each having extremities. These extremities are folded so as to jointly form a slide rail sized to receive and support the folded extremities of the metal furring. The central part also comprises an insulating element devised to be inserted in the upper plate orifice, this insulating element including an orifice. This latter orifice allows introducing a fixing element so as to fix the insulator beneath a floor, or against a joist supporting the floor.

9 Claims, 5 Drawing Sheets

U.S. PATENT DOCUMENTS

| | | | | |
|---|---|---|---|---|
| 3,708,941 | A * | 1/1973 | Cuckson | 52/506.08 |
| 3,733,766 | A * | 5/1973 | Leclercq | 52/480 |
| 4,272,937 | A * | 6/1981 | Brugman | 52/506.07 |
| 4,926,606 | A * | 5/1990 | Hanson | 52/506.07 |
| 7,028,432 | B2 * | 4/2006 | Manos et al. | 52/167.1 |
| 2004/0216398 | A1 | 11/2004 | Manos et al. | |

FOREIGN PATENT DOCUMENTS

| | | |
|---|---|---|
| EP | 481905 A1 * | 4/1992 |
| EP | 1188875 | 3/2002 |
| EP | 1548201 | 6/2005 |
| JP | 2000038800 | 2/2000 |
| JP | 2000087497 | 3/2000 |

OTHER PUBLICATIONS

Vehicle Mountings and Controls, VMC: Spring-FLex Hangers Series SH/RSH, Apr. 2000.*

Vehicle Mountings and Controls, VMC: Neoprene Hangers Series RH/RHD.*

* cited by examiner

ANTI-VIBRATION SOUND INSULATOR FOR SUSPENDED CEILING

CROSS REFERENCE TO PRIOR APPLICATION

This application is a U.S. national phase of International Patent Application Serial No. PCT/CA2005/001718, filed Nov. 10, 2005, which claims priority from Canadian Patent Application Serial No. 2,485,280, filed Nov. 12, 2004 and the disclosures of both applications are incorporated herein by reference in their entirety.

FIELD OF THE INVENTION

The present invention is directed to an anti-vibration sound insulator for a suspended ceiling which is intended to be used either in residential or commercial applications.

BACKGROUND OF THE INVENTION

The common technique used to obtain vibration insulation on a wood floor consists in pouring concrete slab of about 1.5 inch thick on the floor. This technique is efficient but very restricting due to the mass of the concrete slab which is applied to the wood framework.

When a floor is already made of concrete, it is known in the art to fix under the floor a suspended ceiling using metal bars, U-shaped bars or wood furrings. However, such suspended ceilings lead to sound insulation and anti-vibration problems. Indeed, sounds and vibrations can be transmitted from the upper floor to the lower ceiling via the metal bars, the U-shaped bars or the wood furrings.

The present invention resolves these problems by an anti-vibration sound insulator which can be easily fixed under an existing floor in metal or wood, to support, with a certain amount of elasticity, bars or any other means presently being used to fix a ceiling beneath the floor, without any constraint and particularly no mass to support.

SUMMARY OF THE INVENTION

The present invention is directed to an anti-vibration sound insulator for a suspended ceiling fixed under a floor, characterized in that it comprises:

a) a metal furring devised to be fixed on the suspended ceiling, the furring being formed by a U-shaped metal sheet having a median section fixed to the suspended ceiling and two extremities folded outwardly away from the U;

b) a central part devised to connect the furring to the floor, the central part comprising:

i) a star-shaped element comprising an upper vertical plate provided with an orifice and two lower plates each having extremities, the extremities of the lower plates being folded so as to jointly form a slide rail, the slide rail being sized to receive and support the folded extremities of the metal furring;

ii) an insulating element designed to be inserted in the upper plate orifice, the insulating element comprising an other orifice; and c) means for fixing the central part to the floor, to a joist thereof or to any other building element fixed beneath the floor, the means comprising a fixing element to be inserted in the insulating element orifice in order to fix the star-shaped element to the floor, to the joist or to the other building element fixed beneath the floor.

The invention also relates to the use of the anti-vibration sound insulator for suspending a ceiling beneath a floor.

The invention will be better understood upon reading of the following non-limitative description made with reference to the appended drawings.

DETAILED DESCRIPTION OF THE INVENTION

Figure 1:
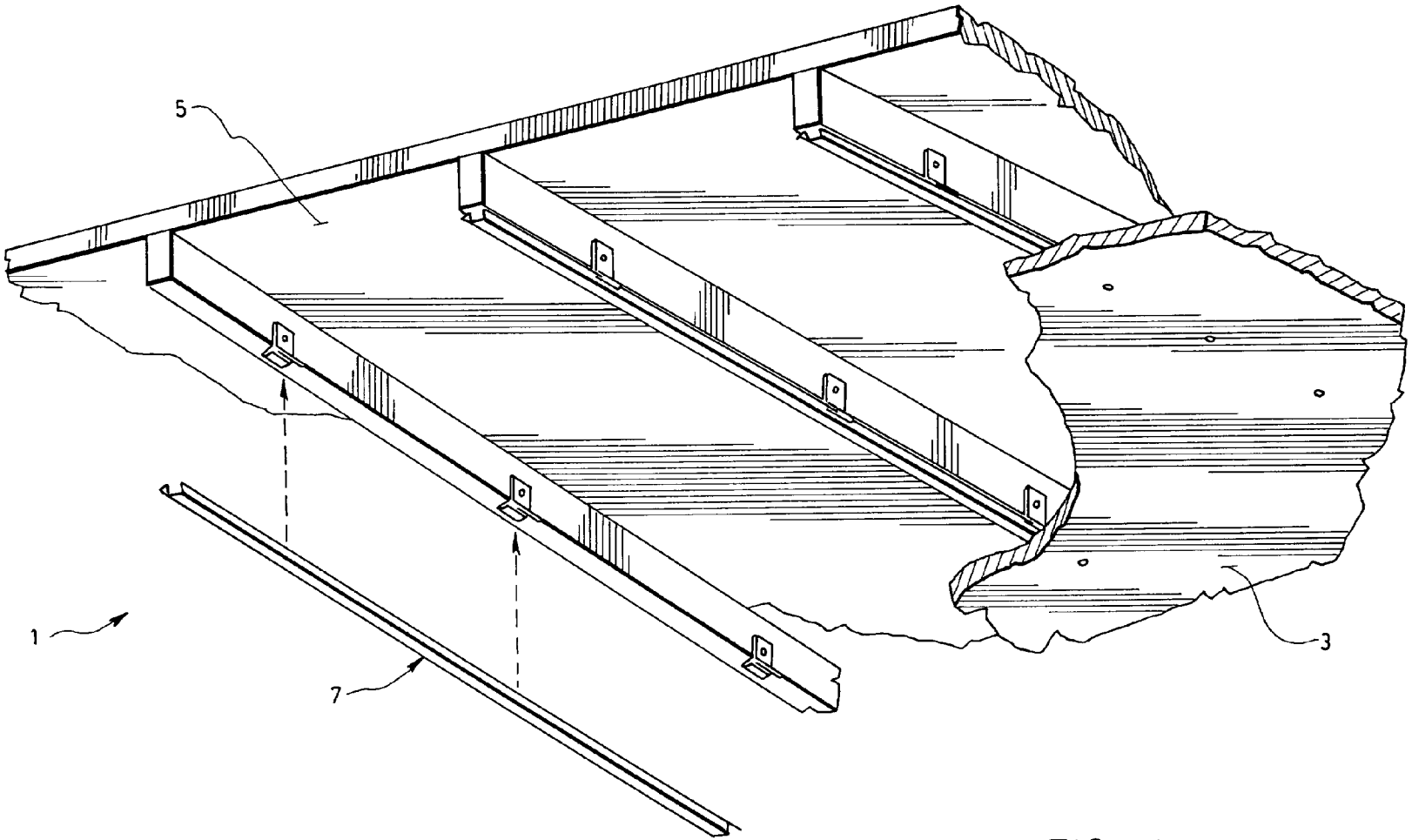
FIG. 1 is a perspective view of a suspended ceiling placed beneath a floor using anti-vibration sound insulators according to the invention fixed to the floor joists.

As illustrated in FIG. 1, the invention relates to an anti-vibration sound insulators (1) devised to be installed between a suspended ceiling (3) and a floor (5).

The sound insulators according to the present invention comprise metal furrings (7) devised to be fixed conjointly parallel to the upper surface of the suspended ceiling (3).

Figure 2:
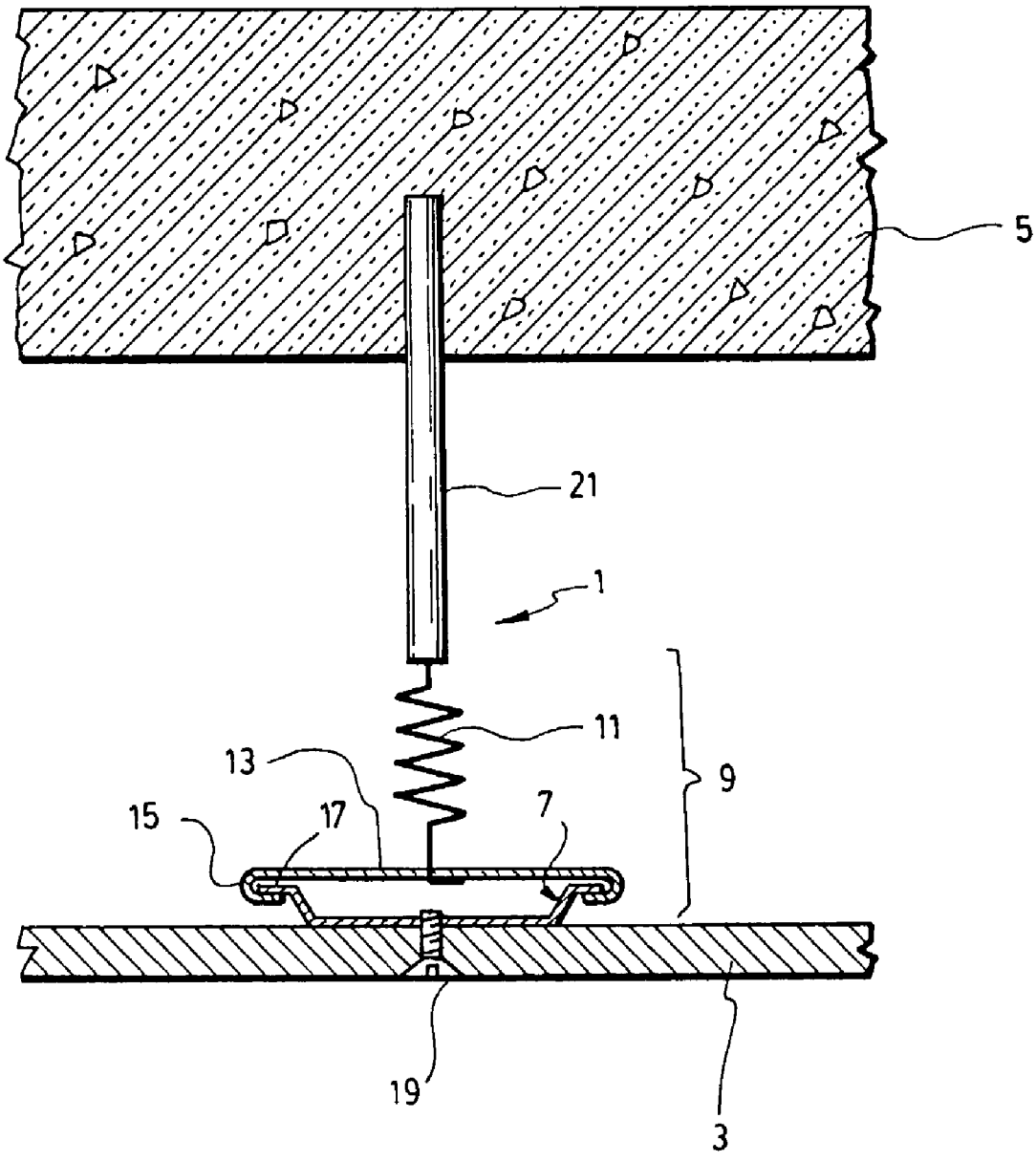
FIG. 2 is a cross-sectional view of an anti-vibration sound insulator for a suspended ceiling fixed beneath a floor, said view illustrating the general principle of the invention.

The general principle of the invention is illustrated in FIG. 2, where the anti-vibration sound insulator (1) according to the invention is used to suspend a suspended ceiling (3) immediately under a floor (5), the insulator being directly fixed between the floor and the ceiling.

The material constituting the ceiling (3) may be any material commonly used for the manufacturing of such a ceiling, such as gypsum, wood, acoustic tiles or any other decorative facing.

The floor (5) under which the ceiling (3) is suspended may also be made of any standard material such as concrete, cement, wood, steel or any other material used in the building field.

The general principle of the invention illustrated in FIG. 2 shows that the anti-vibration insulator (1) according to the invention comprises a central part (9) designed to absorb and minimize vibrations coming from the floor (5). This absorption will be possible if an element having elastic properties is present between the floor (5) and the ceiling (3). Such an elastic element has been represented as being a spring (11). One of the extremities of this spring is connected to a slide rail (13) having extremities (15) designed to receive extremities (17) of a standard metal furring (7) which is fixed above the ceiling (3) using means such as screws (19), nails or clips.

The anti-vibration sound insulator (1) according to the general principle of the invention also comprises a fixing means (21) devised to be fixed in the floor (5). This fixing means may be carried out using any fixing element known in the field of the invention, such as, for example, by introducing a screw in an orifice provided to that effect and fixing by means of a retainer bar.

In this general embodiment of the invention, the metal furring (7) consists of a U-shaped metal plate having two lateral extremities forming external horizontal tabs (17) which may be retained in the folded extremities of the slide rail (15).

One will understand however, that other systems for fixing the absorbing element may be used depending on the nature of the elements used for suspending the ceiling (3), such as metal bars, wood furrings or any other element known in the field.

One of the main advantages of the present invention is the use of metal furrings (7) devised to support the suspended ceiling, which may be fixed directly to the slide rails (13) without having to be screwed or nailed, thus facilitating its installation.

One will understand that a single furring, having a length adapted to the size of the ceiling to be fixed, may be retained by several sound insulators fixed beforehand along a straight line beneath the floor (5) (FIG. 1). According to the general embodiment of the invention illustrated in FIG. 2, the furring is laterally inserted in the slide rails (13) of the central parts (9).

As previously mentioned, one will understand that the anti-vibration sound insulator according to the present invention acts according to the principle that the spring cancels the acoustical and mechanical energy of the floor produced when one walks on it. The system is advantageously calibrated in order to ensure the stability of the suspended ceiling in the long term, with a load capacity which may be as high as 100 pounds per square foot.

One will also understand that the anti-vibration sound insulator may be made of metal or a multi-composite material. The different parts thereof may be moulded, folded and/or thermoformed.

Finally, one will understand that various modifications may be done to this general embodiment of the invention, as described in the following Examples and shown in FIGS. 3 to 6 enclosed herewith, without departing from the scope of the invention.

Figure 3:
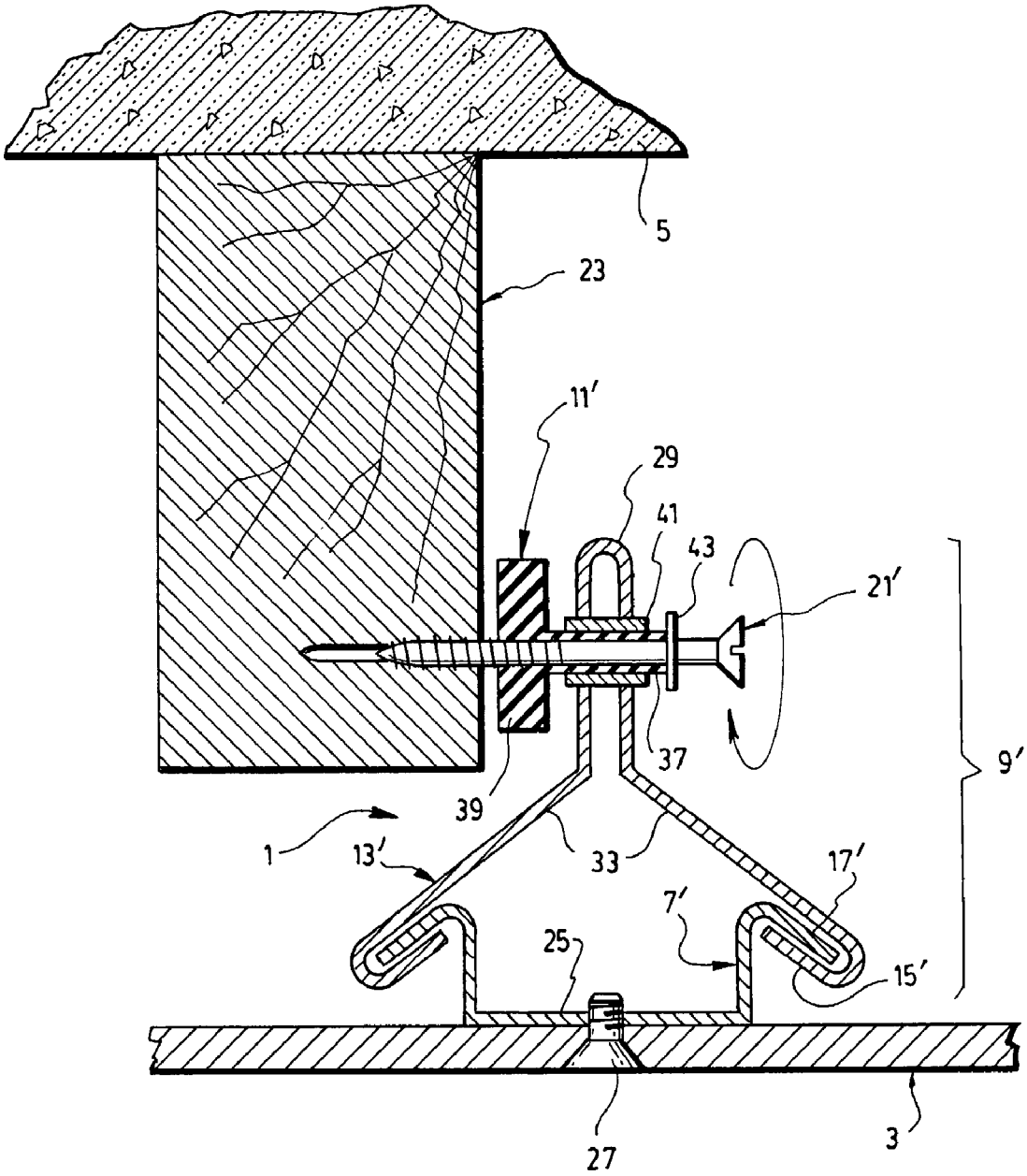
FIG. 3 is a cross-sectional view of an anti-vibration sound insulator for a suspended ceiling according to a first preferred embodiment of the invention, wherein the anti-vibration sound insulator is fixed to a joist supporting the floor.
Figure 4:
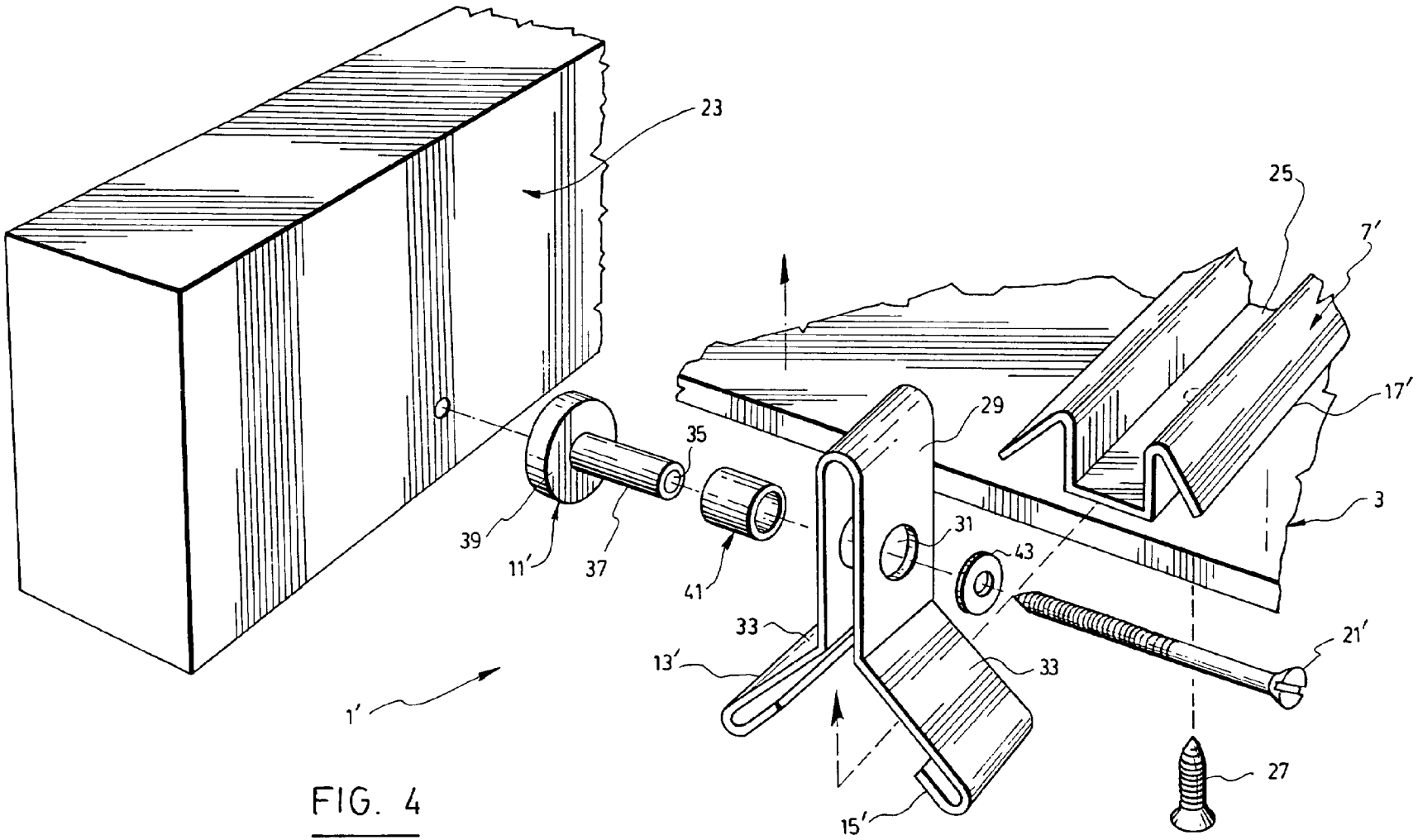
FIG. 4 is an exploded perspective view of the anti-vibration sound insulator shown in FIG. 3.

According to a first preferred embodiment illustrated in FIGS. 3 and 4, the anti-vibration sound insulator (1') for suspended ceiling according to the invention comprises:

- a specifically adapted metal furring (7') devised to be fixed to the suspended ceiling (3),
- a central part (9') devised to connect the furring to the floor (5), and
- a fixing means such as a screw (21') for fixing the central part to a joist (23) supporting the floor (5).

The metal furring (7') is formed by a long plate, preferably made of galvanized metal, having a U shape and having a median section (25) and two extremities (17'). The furring extremities (17') are folded outwardly away from the U.

Preferably, the angle formed by the folded extremities with respect to the vertical plane may vary of from about 10 to 90°. An angle of 10° corresponds to a quasi-complete folding of the extremities towards the bottom. An angle of 90° corresponds to a horizontal folding of the furring extremities (17), as shown in FIG. 2. Even more preferably, the folding angle is about 60°.

As shown in FIGS. 3 and 4, the median section (25) of the furring (7') is used to fix the furring to the suspended ceiling using one or more fixing means known in the field, such as screws (27).

The central part (9') of the sound insulator also comprises a star-shaped central element, made from a single piece which is preferably folded or moulded. The star-shaped element comprises an upper portion (29) having an orifice (31) and two lower portions (33) having extremities which are folded inwardly (15') in order to form a slide rail. This slide rail is sized to receive and support the folded extremities (17') of the metal furring (7').

According to a preferred embodiment of the invention, the star-shaped element of the central part may be made of metal, galvanized metal or a composite material, and more preferably of galvanized metal.

One will understand that the folding angle of the furring extremities (17') depends on the shape of the star-shape element (13') of the central part (9'), so as to allow the extremities to be perfectly inserted in the slide rail of the star-shape element.

One will also understand that a folding angle of the extremities which is lower than 90° allows an increase in the solidity of the insulator when the ceiling is suspended by avoiding any problem with disengagement of the furrings.

The star shape of the element (13') gives it strength and elasticity properties.

Firstly, the weight of the load to be fixed is divided and shifted on either side of the central part.

Secondly, the star-shaped element, when made of metal, has some flexibility due to the loop form of the upper part (29).

The loop may close under the weight of the ceiling thus increasing the pressure exerted by the slide rail on the furring extremities. The loop may also open thus easily allowing introduction and fixation of the furring in the slide rail by merely applying pressure. The presence of the loop gives floor vibration absorption properties to the star-shaped element according to the invention.

Finally, an angle of the furring extremities (17') lower than 90° allows avoiding any eventual disengagement of the furring from the slide rail of the star-shaped element.

As illustrated in FIGS. 3 and 4, the central part (9') of the sound insulator (1') also comprises an insulating element (11') devised to be inserted in the orifice (31) of the star-shaped element upper plate (29). This insulating element (11') has elastic properties similar to those of the spring (11) shown in FIG. 2, and allows absorption of the vibrations coming from the floor. This insulating element also comprises an orifice (35).

One will understand that the insulating element absorbing properties are due to the fact that this element is made of rubber or any other synthetic material having rubber-like elastic properties.

The insulating element (11') shown in FIGS. 3 and 4 comprises two portions. A first portion (37) is designed to be inserted in the upper plate (29) orifice of the star-shaped element. The second portion (39) is designed to be placed between the upper part (29) of the star-shaped element and one of the vertical sides of the joist (23) where the sound insulator is fixed. The presence of this second element allows absorption of the vibrations between the joist and the central part of the sound insulator.

The insulating element orifice (35) allows insertion of the screw (21') and thus fixation of the central part to the joist (5').

One will understand that the fixing element, such as the screw (21') which is directly in contact with the joist and thus with the floor, is isolated from the other parts of the sound insulator via the insulating element (11').

In the preferred embodiment of the invention illustrated in FIGS. 3 and 4, the insulator (1') is fixed to the joist (23) using a screw, a nail or a bolt. One will understand that the fixing element should be long enough in order to run through the insulating element (11') and penetrate into the joist.

The sound insulator shown in FIGS. 3 and 4 also comprises a rigid element (41) for protecting the insulating element in order to avoid its deformation under the weight of the suspended ceiling. This rigid element is sized to be inserted in the upper plate orifice (31) and around the insulating element (37). Preferably, the rigid protecting element may be a sleeve made of metal, galvanized metal or composite material.

The sound insulator shown in FIGS. 3 and 4 further comprises a metal washer (43) inserted on the screw on the opposite side of the second portion of the insulating element.

One will understand that this washer allows protection of the insulating element when tightening the screw into the joist. One will also understand that during tightening of the screw, the metal washer softly crushes the external surface of the insulating element (11') thus increasing the insulating properties of the screw (21') and of the rigid element (41), and the overall strength of the insulator (1') at the same time.

Figure 5:
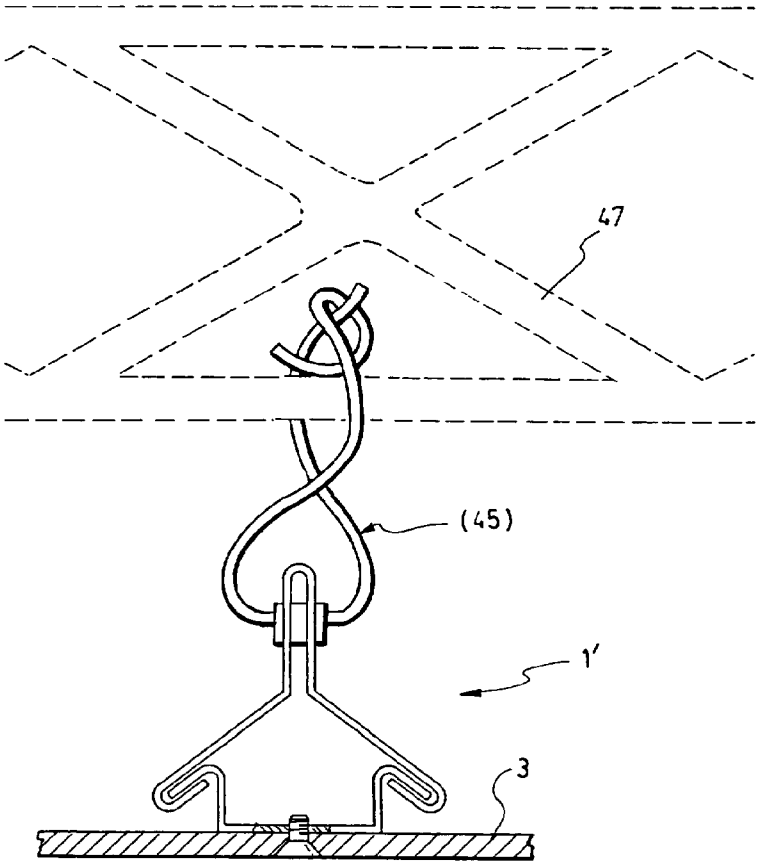
FIG. 5 is a cross-sectional view of an anti-vibration sound insulator for a suspended ceiling according to a second preferred embodiment of the invention, wherein the anti-vibration sound insulator is fixed to an openwork metal beam supporting the floor.

A second preferred embodiment of the invention is illustrated in FIG. 5. The sound insulator (1') is directly fixed to an openwork metal beam (45) using a metal wire or a cable (45). The metal wire or the cable may also be wound around another building element placed under the floor, such as a metal or wood beam, or an iron bar.

Figure 6:
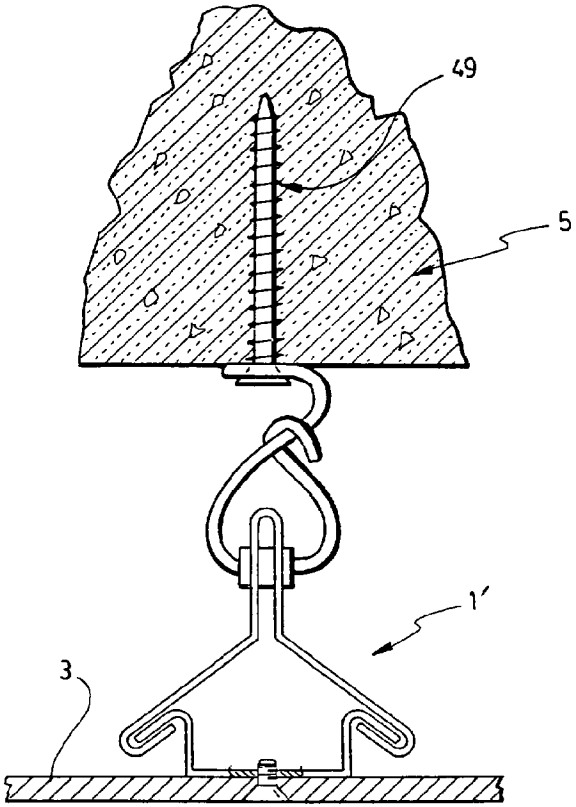
FIG. 6 is a cross-sectional view of an anti-vibration sound insulator for a suspended ceiling according to a third preferred embodiment of the invention, wherein the anti-vibration sound insulator is directly fixed beneath the concrete floor using a screw.

A third preferred embodiment of the invention is illustrated in FIG. 6. In this case, no building element is present under the floor in order to fix the insulator (1'). The insulator (1') is thus fixed under the floor using a metal wire or a cable (45) which is itself directly fixed to the floor using a screw (47). The screw or any other fixing element is fixed to the floor (5) beforehand.

Various modifications could be made to the invention as described hereinabove without departing from the scope of the present invention.

The invention claimed is:

1. An anti-vibration sound insulator for a suspended ceiling fixed under a floor, wherein the anti-vibration sound insulator comprises:

a metal furring devised to be fixed on the suspended ceiling, said furring being formed by a U-shaped metal sheet having a median section fixed to the suspended ceiling and two extremities folded outwardly away from the median section of the U-shaped metal sheet;

a central part devised to connect the furring to the floor, said central part comprising:

i) a star-shaped element comprising an upper vertical plate provided with an orifice and two lower plates each having extremities, said extremities of said lower plates being folded so as to jointly form a slide rail, said slide rail being sized to receive and support the folded extremities of the metal furring;

ii) an insulating element designed to be inserted in the upper plate orifice, said insulating element comprising an other orifice;

a rigid element configured to protect the insulating element, said rigid element being sized to be inserted between the upper plate orifice and the insulating element; and means for fixing the central part to the floor, to a joist thereof or to any other building element fixed beneath the floor, said means comprising a fixing element to be inserted in the insulating element orifice in order to fix the star-shaped element to the floor, to the joist or to the other building element fixed beneath the floor.

2. The anti-vibration sound insulator of claim 1, wherein the insulating element comprises a first portion designed to be inserted in the upper plate orifice of the star-shaped element, and a second portion designed to be placed between the upper part of the star-shaped element and a vertical side of the joist or the other building element fixed beneath the floor.

3. The anti-vibration sound insulator of claim 1 wherein the rigid element protecting the insulating element is a sleeve made of a metal, a galvanized metal or a composite material.

4. The anti-vibration sound insulator of claim 1, wherein the star-shaped element consists of a single piece, said piece being molded or folded to form said star-shaped element.

5. The anti-vibration sound insulator of claim 1, wherein the star-shaped element is made of a metal, a galvanized metal or a composite material.

6. The anti-vibration sound insulator of claim 1, it further comprising a metal washer, said washer being sized to be introduced in the fixing element to be inserted in the insulating element orifice on an opposite side of the second portion of the insulating element.

7. The anti-vibration sound insulator of claim 1, wherein the fixing element used to fix the central part to the floor, to the joist thereof or to the other building element fixed beneath said floor, is a screw, a nail, a bolt, a metal wire or a cable.

8. The anti-vibration sound insulator of claim 1, wherein the insulating element is made of rubber or other material with elastic properties.

9. Use of the anti-vibration sound insulator as defined in claim 1 for suspending a ceiling beneath a floor.

* * * * *

UNITED STATES PATENT AND TRADEMARK OFFICE

CERTIFICATE OF CORRECTION

PATENT NO. : 7,743,572 B2
APPLICATION NO. : 11/719080
DATED : June 29, 2010
INVENTOR(S) : Robert Ducharme It is certified that error appears in the above-identified patent and that said Letters Patent is hereby corrected as shown below:

Column 6, line 24 (approx.) – In Claim 3, delete "claim 1" and insert -- claim 1, --

Column 6, line 34 (approx.) – In Claim 6, after "claim 1," delete "it"

Signed and Sealed this

Fifth Day of October, 2010

David J. Kappos

David J. Kappos
*Director of the United States Patent and Trademark Office*